US006472989B2

(12) United States Patent
Roy, Jr.

(10) Patent No.: US 6,472,989 B2
(45) Date of Patent: Oct. 29, 2002

(54) CHILD PROTECTION BRACELET

(76) Inventor: Frederick H. Roy, Jr., 252 Amberly Rd., Virginia Beach, VA (US) 23462

( * ) Notice: Subject to any disclaimer, the term of this patent is extended or adjusted under 35 U.S.C. 154(b) by 0 days.

(21) Appl. No.: 09/777,257

(22) Filed: Feb. 6, 2001

(65) Prior Publication Data

US 2002/0003477 A1 Jan. 10, 2002

Related U.S. Application Data

(63) Continuation-in-part of application No. 09/515,599, filed on Feb. 29, 2000.

(51) Int. Cl.[7] ..... G08B 23/00

(52) U.S. Cl. ..... 340/573.4; 340/571; 340/572; 340/551; 340/568

(58) Field of Search ..... 340/573, 571, 340/572, 568, 551

(56) References Cited

U.S. PATENT DOCUMENTS

| | | | | | |
|---|---|---|---|---|---|
| 4,095,214 | A | * | 6/1978 | Minasy | 340/258 |
| 4,510,489 | A | | 4/1985 | Anderson, III et al. | |
| 4,555,696 | A | * | 11/1985 | Brown | 340/551 |
| 4,684,933 | A | * | 8/1987 | Dill | 340/572 |
| 4,694,284 | A | * | 9/1987 | Leveille et al. | 340/574 |
| 5,006,830 | A | * | 4/1991 | Merritt | 340/573 |
| 5,293,674 | A | | 3/1994 | Hendrix | |
| 5,367,289 | A | | 11/1994 | Baro et al. | |
| 5,392,028 | A | * | 2/1995 | Pichl | 340/572 |
| 5,859,587 | A | | 1/1999 | Alicot et al. | |
| 5,900,817 | A | * | 5/1999 | Olmassakian | 340/573.1 |
| 6,031,460 | A | * | 2/2000 | Banks | 340/573 |
| 6,072,392 | A | * | 6/2000 | Henderson et al. | 340/573.1 |
| 6,195,009 | B1 | * | 2/2001 | Irizarry et al. | 340/573.4 |

* cited by examiner

*Primary Examiner*—Jeffery Hofsass
*Assistant Examiner*—Hung Nguyen
(74) *Attorney, Agent, or Firm*—Norman B. Rainer

(57) ABSTRACT

A child protection bracelet for preventing unauthorized passage of a child through the monitored entrance or exit region of a public facility includes a flexible band which can be locked upon a child's wrist or ankle. Attached to the band is a housing which protectively confines an alarm-activating component which is activated by passage through said monitored region.

5 Claims, 2 Drawing Sheets

CHILD PROTECTION BRACELET

RELATED APPLICATIONS

This application is a continuation-in-part of U.S. patent application Ser. No. 09/515,599, filed Feb. 29, 2000.

BACKGROUND OF THE INVENTION

1. Field of the Invention

This invention relates to the protection of children within a public area having a surveillance perimeter, and more particularly concerns a system for detecting a child's passage through said perimeter and providing appropriate alerting and countermeasures.

2. Description of the Prior Art

Many large retail stores have a multitude of long, high counters with intervening aisles, large displays, separate rooms, and a number of floors. A child can easily become lost in such environment, particularly amidst a multitude of shoppers. There is the further possibility that the child may become the victim of a kidnapper. Because the parent may be engrossed in the shopping activity, the fact that the child is missing may not be detected for a significant period of time, during which the child may, by virtue of wandering or abduction, be located far from the parent. Such concerns are also prevalent at other public facilities such as libraries, museums, theme parks, coliseums and stadiums.

Devices such as leashes have earlier been disclosed to facilitate the tethered connection of the parent to the child. However, such devices are impractical in the shopping center environment because of the close contact with people and store merchandising structures.

A child-locating bracelet which can be locked onto a child's wrist is disclosed in U.S. Pat. No. 6,031,460 to Banks. The Banks bracelet employs a radio transmitter or a GPS system, thereby involving expensive, shock-sensitive components, and requiring the use of an included battery.

Electronic article surveillance (EAS) systems are well known for the prevention of shoplifting. Such systems generally involve the attachment of an alarm-triggering marker or security tag to an item of merchandise, and sensor means located adjacent the store entrance and/or exit A for detecting the tag. Examples of such tags are disclosed in U.S. Pat. Nos. 3,942,829; 3,995,900; 4,649,397; 4,686,516; 4,774,503; and elsewhere. One such surveillance system, as disclosed for example in U.S. Pat. No. 5,877,728, uses Radio Frequency (RF) based digital signal processing. When a "live" tag enters the sensor's effective radio frequency detection field, an alarm is triggered that alerts personnel to a possible shoplifting attempt. The tag includes a resonant circuit that disrupts a radio frequency beam directed from a pedestal to a receiver located oppositely across the monitored pedestrian walkway.

For example, radio frequency EAS systems usually include both a transmit antenna and a receive antenna which collectively establish a surveillance zone, and tags which are attached to articles being protected. The transmit antenna generates a variable frequency electromagnetic field within a range of a first predetermined frequency. The resonant circuit of the tag is usually comprised of an antenna and diode, or antenna and capacitor, and has a predetermined resonant frequency. When one of the tags is present in the surveillance zone, the field generated by the transmit antenna induces a voltage in the resonant circuit in the tag, which causes the resonant circuit to generate an electromagnetic field, causing a disturbance in the field within the surveillance zone. The receive antenna detects the electromagnetic field disturbance and generates a signal indicating the presence of the tag (and thus, the protected article attached to the tag) in the surveillance zone.

A second type of electronic shoplifting surveillance system utilizes magnetic and acousto-magnetic merchandise tags for disrupting the signal from a sensor's detection field. Such tags contain two pieces of thin metal that are caused to vibrate within the detection field. The vibration produces a disruptive frequency which interacts with a store exit detector.

Typically a magnetic system marker consists of a first elongated element of high magnetic permeability ferromagnetic material disposed adjacent to at least a second element of ferromagnetic material having higher coercivity than the first element. When subjected to an interrogation frequency of electromagnetic radiation, the marker causes harmonics of the interrogation frequency to be developed in the receiving coil. The detection of such harmonics indicates the presence of the marker.

A third type of EAS system employs magnetic harmonic markers which include a thin strip or wire of magnetic material that responds to an alternating interrogation signal by generating a signal pulse that is rich in high harmonics of the interrogation signal. Such markers are disclosed in U.S. Pat. No. 4,660,025 to Humphrey and U.S. Pat. No. 4,980,670 to Humphrey et. al.

A fourth type of EAS system employs magnetomechanical markers that include a magnetostrictive element. For example, U.S. Pat. No. 4,510,489, issued to Anderson et. al., discloses a marker formed of a ribbon-shaped length of a magnetostrictive amorphous material contained within a hollow recess in an elongated housing in proximity to a biasing magnetic element. The magnetostrictive element is fabricated such that it is mechanically resonant at a predetermined frequency when the biasing element has been magnetized to a certain level. At the interrogation zone, a suitable oscillator provides an AC magnetic field at the predetermined frequency, and the magnetostrictive-element mechanically resonates at this frequency upon exposure to the field when the biasing element has been magnetized to the aforementioned level. The resulting signal radiated by the magnetostrictive element is detected by detecting circuitry provided at the interrogation zone.

A fifth type of EAS system involves microwave activation.

EAS systems which use magnetomechanical markers have proved to be very effective and are in widespread use. Systems of this type are sold under the brand name "Ultra*Max". In operating such systems, it is customary to attach magnetostrictive markers to the items of merchandise at retail stores which maintain equipment for generating the field for the interrogation zone. The attachment of the markers to the items of merchandise is typically carried out by means of a pressure sensitive adhesive layer provided on the marker, or, when the marker is intended to be removable, by a mechanical clamping device or the like. One example of such a device is disclosed in U.S. Pat. No. 5,031,756, issued to Buzzard et. al., which is directed to a "keeper" which may be utilized in a retail store. The keeper includes a frame for holding a compact disk or similar item until the compact disk is paid for at a checkout counter. The keeper disclosed by Buzzard et. al. includes an EAS marker which may be a magnetomechanical marker of the type described in the Anderson et. al. patent.

U.S. Pat. No. 5,392,028 to Piche concerns a merchandise tag which incorporates two different kinds of EAS markers, namely the resonant circuit of the first above-mentioned system, and a magnetizable strip, as in the above-mentioned third system.

When a tag triggers an alarm at the exit site of the store, a procedure is activated which may include. the directed focusing of surveillance cameras and/or the alerting of security personnel.

In some of said shoplifting surveillance systems, the alarm tag can be removed by authorized store personnel using specialized devices, thereby enabling the customer to leave the store with the purchased merchandise. In other systems, the alarm tag is deactivated by magnetic or other principles instead of being removed. Such deactivation generally prevents reuse of the tag. It is also important to note that different stores may utilize various kinds of marker tags and detector systems.

Systems for electronically monitoring the whereabouts of children have been disclosed in U.S. Pat. Nos. 4,598,272; 4,598,275; 4,785,291; 5,689,240; 5,812,056; 5,841,352; 5,900,817, and elsewhere. In general, such devices either require continuous monitoring or involve conditions of use which are incompatible with a retail shopping center environment. The use of EAS tags on children has also been proposed. However, it should be noted that a shopping parent with a child may walk to a number of separate stores in a shopping center, each with its own distinctive EAS system.

It is accordingly an object of the present invention to provide a surveillance system for preventing the undesired passage of a child through the exit of a public facility.

It is another object of this invention to provide a system as in the foregoing object which utilizes a security tag compatible with exit detectors typically employed in EAS systems.

It is a further object of the present invention to provide a security tag useful in the system of the aforesaid nature which is attachable to the child as a locked protection bracelet.

It is still another object of this invention to provide a bracelet of the aforesaid nature capable of protectively holding any alarm activating security tag employed in current EAS systems.

It is an additional object of the present invention to provide a bracelet of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a child protection bracelet of lightweight construction comprising:

1) a flexible band elongated upon a center axis between opposite first and second extremities and having a series of apertures disposed upon said axis adjacent said first extremity, said band having axially extending steel wires embedded therein,
2) a lock pin having a head extremity embedded within said band and a stem emergent from said head extremity and adapted to penetrate one of said apertures when said band is doubled upon itself in a circuitous path, and
3) a housing having a substantially flat bottom panel provided with a hole that receives said stem, and an upper shell portion sealed to said bottom panel, said housing protectively confining:
   a) centrally located locking means for releasibly engaging said stem, and
   b) EAS alarm-activating components.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
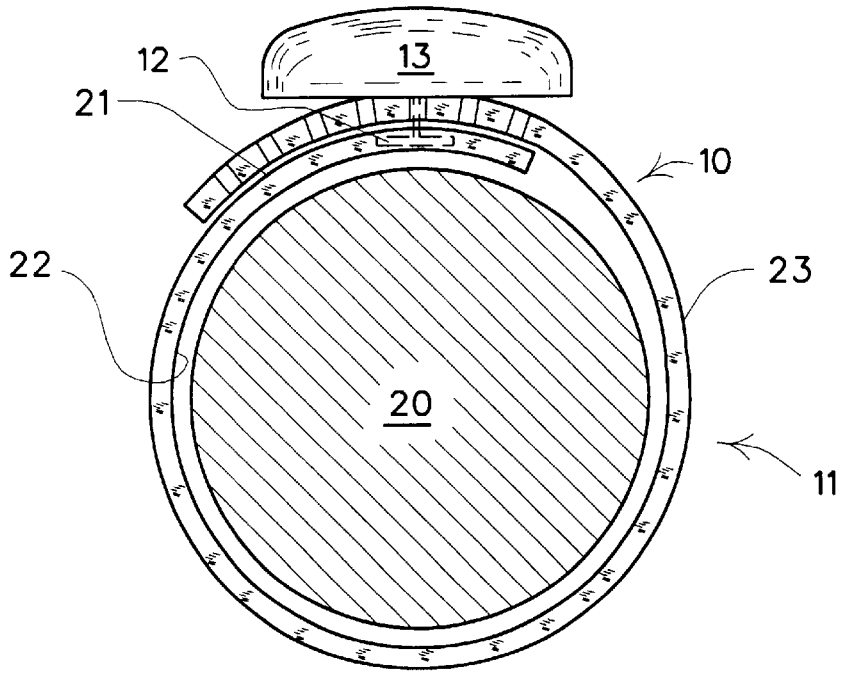
FIG. 1 is a side view of an embodiment of the protection bracelet of the present invention shown as worn on a child's wrist or ankle.

Referring now to FIGS. 1–4, an embodiment of the protection bracelet 10 of the present invention configured to be worn by a child as a wrist or ankle bracelet is shown comprised of flexible band 11 which secures lock pin 12 interactive with housing 13.

Flexible band 11 is elongated upon a center axis 14 between opposite first and second extremities 15 and 16, respectively. A series of apertures 17 is disposed upon said axis adjacent said first extremity. Axially extending compliant steel reinforcement 18 is embedded within the band to prevent easy removal with cutting tools. Said steel reinforcement may be wires, ribbons or belts of braided or woven construction. Supplemental steel reinforcement may be disposed transversely to axis 14. The band is preferably fabricated of a pliable rubbery stock of the type employed in steel-belted automobile tires. Preferred rubbers are those having a Shore A hardness between 30 and 80. Other materials may, however, be utilized for fabrication of the band.

The term "flexible" is intended to denote a compliant but non-elongatable substrate capable of bending upon said axis to an extent permitting both extremities to be brought together in a substantially circular planar path. Band 11 is bounded in part by parallel edges 19 which define a width preferably between ½ and 1½ inches. The length of said band, measured axially between said extremities, may range from 7 to 10 inches. The length must be sufficient to permit the band to encircle a wrist or ankle 20 while providing an overlap region 21 of one to two inches. The thickness of the band, measured between inner and outer flat surfaces 22 and 23, respectively, may be between 2 and 5 millimeters. Cushioning material may be applied to said inner surface for comfort, and the outer surface may be decorated to provide an aesthetically pleasing effect.

Figure 2:
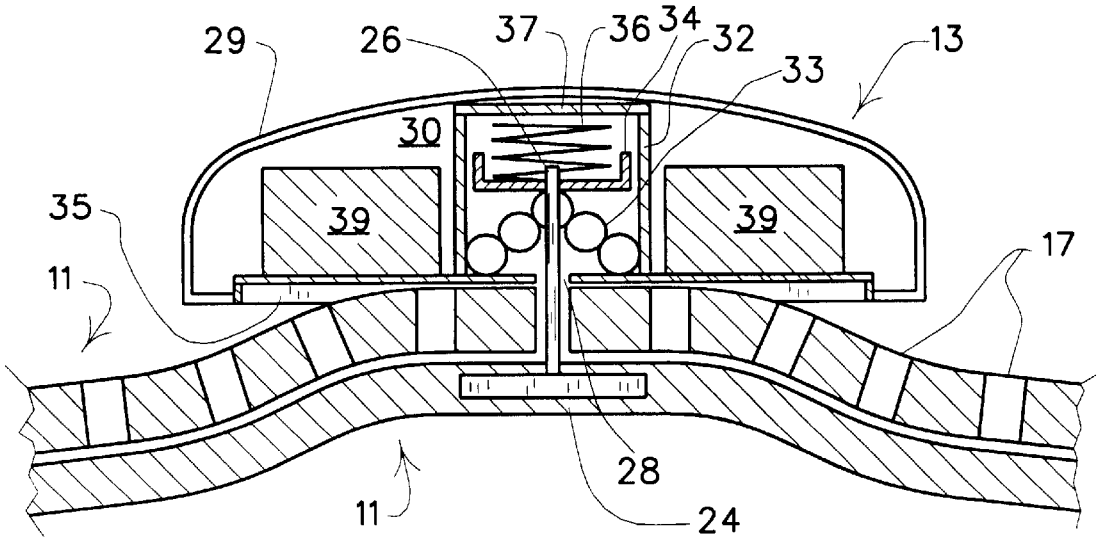
FIG. 2 is an enlarged fragmentary vertical sectional view of the embodiment of FIG. 1.
Figure 3:
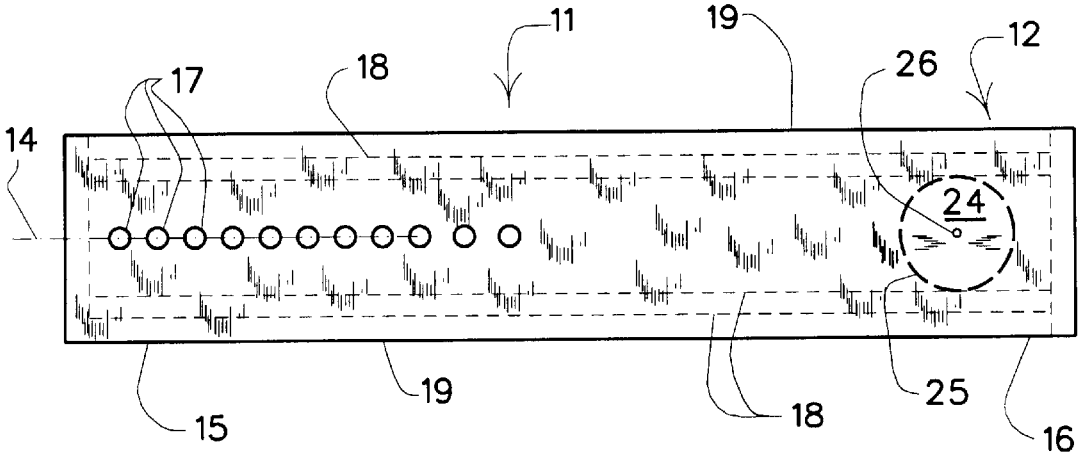
FIG. 3 is an enlarged plan view of the band component of the embodiment of FIG. 1.
Figure 4:
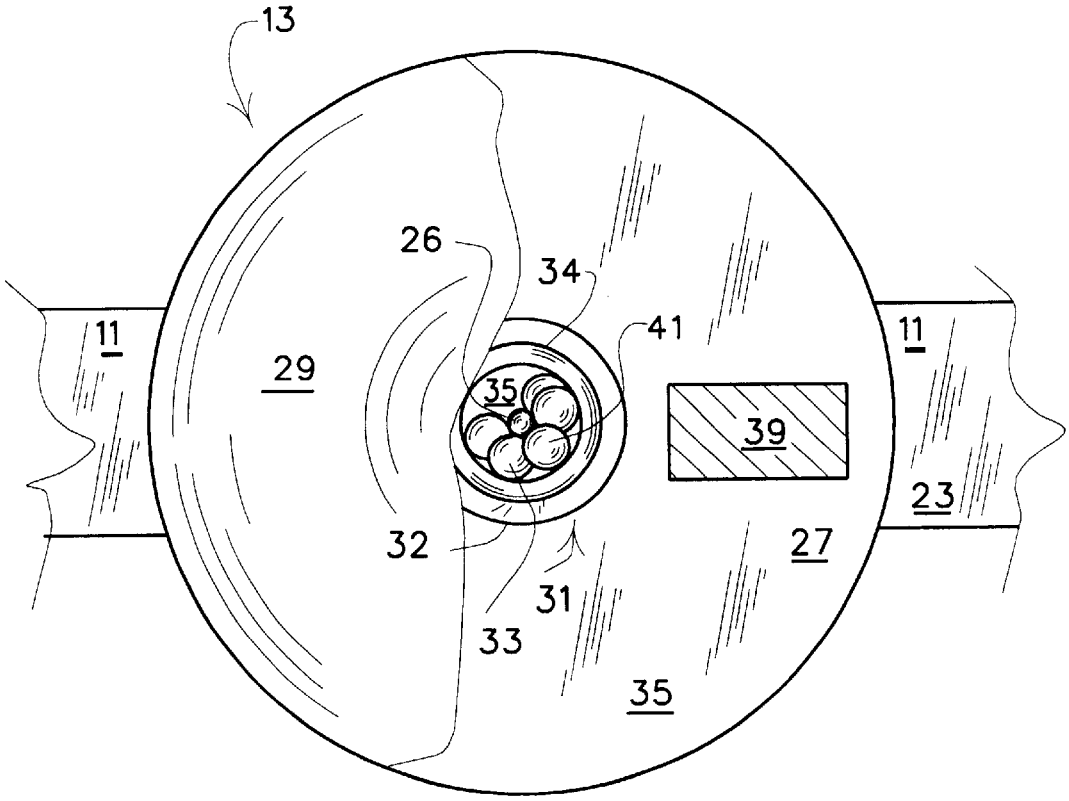
FIG. 4 is a top view of the embodiment of FIG. 2 with portions broken away to reveal interior details.

Lock pin 12 has a head extremity 24 which is embedded within band 11. Although said head extremity is exemplified as having a circular perimeter 25, perimeters of other shapes may be employed. A straight rigid stem 26 is emergent from said head extremity and further emergent from outer surface 23 of band 11. Said stem is configured and positioned so as to penetrate an aperture 17 when said band is circled, as shown in FIGS. 1 and 2.

Housing 13 has a substantially flat bottom panel 27 provided with a hole 28 that receives stem 26. An upper shell portion 29, preferably of dome shape, is sealed to bottom panel 27, thereby defining a protective enclosure region 30 which prevents unauthorized access. Shell portion 29 is fabricated of a rugged thermoplastic composition such as polycarbonate or other engineering grade polymer material. Panel 27 is preferably configured and disposed to form an upwardly recessed region 42 which thwarts tamper access to stem 26 in the area between the band and housing.

A locking mechanism 31 is centrally disposed within region 30. Said locking mechanism is adapted to engage the inserted stem 26 of said lock pin. The exemplified embodiment of the locking mechanism comprises a holding chamber 32 which confines five ball bearings 33. A spring cup 34, having a bottom panel 35 penetratable by stem 26, is positioned atop said ball bearings. A coil spring 36 is disposed within cup 34 coaxially with the direction of penetration of stem 26. Said spring 36 rests in abutment between panel 35 and an upper surface 37, which may be part of chamber 32 or shell portion 29.

As stem 26 is inserted through bottom panel 35 into said locking mechanism, bearings 33 are spread apart by the upward motion of the stem. When the stem is fully inserted, the bearings are forced into tight frictional engagement with the stem by the action of spring 36. Such frictional force is sufficient to prevent downward removal of the stem from housing 13, thereby producing a locked condition.

If one were to try to forcefully pull housing 13 upwardly away from band 11 in the locked state of the bracelet, bearings 33 would be pulled downward against bottom panel 35 and sidewall of cup 34. This causes even stronger gripping of stem 26 by bearings 33.

It has been found that, if only four bearings 33 are employed, instead of the five bearings utilized in the locking mechanism 31 of the bracelet of this invention, the locking mechanism can be defeated by rotating housing 13 while pulling it away from the band. It was also found that, by adding a fifth bearing 41 atop the other four bearings, the aforesaid rotation and pulling technique of dislodging the housing from the band can be prevented. Although the fifth bearing allows the lower four bearings to rotate and travel circumferentially around said stem, it prevents axial movement of said lower four bearings, thereby preventing removal of the stem from the locking mechanism.

Also confined within region 30 are EAS alarm-activating components 39. Said EAS components include at least a resonant circuit capable of interaction with a radio frequency signal, and a magnetic element capable of interacting with an AC magnetic field.

Region 30 will preferably also include components interactive with microwave and acousto-magnetic EAS systems. Accordingly, region 30 would confine components interactive with substantially all currently employed EAS systems.

In utilizing the protection bracelet of this invention, the public facility, such as a retail store, will offer to parents with children a bracelet of this invention upon their entrance to the facility. The housing of the bracelet would contain an EAS alarm-activating component which is compatible with the surveillance system located at the exits and/or entrances of said facility. The parent or store employee would then apply the bracelet by wrapping the band snugly around the child's wrist or ankle, and inserting stem 26 through a suitable aperture 17. Housing 13 is then applied by pushing firmly to cause stem 26 to penetrate hole 28 and enter locking mechanism 31. Upon leaving the facility, the bracelet would be removed and returned before exiting through the surveillance zone.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A protection bracelet of lightweight construction adapted to be functionally employed upon a child's wrist or ankle, comprising:

a) a flexible band elongated upon a center axis between opposite extremities and bounded by inner and outer surfaces, said band having axially extending steel wire reinforcement embedded therein, b) a lock pin having a head associated with said band and a stem emergent from said head and further emergent from the outer surface of said band, said stem adapted to penetrate said band when said band is doubled upon itself in a circuitous path of adjustable size, and c) a housing having a substantially flat bottom panel provided with a hole that receives said stem, and a shell portion sealed to said bottom panel, said housing protectively confining:

1) locking means for releasibly engaging said stem, and comprised of ball bearings and a spring which forces said bearings into tight frictional engagement with said stem, and 2) at least one EAS alarm-activating component.

2. The bracelet of claim 1 wherein the bottom panel of said housing is provided with a recessed region directed upwardly toward said shell portion.

3. The bracelet of claim 1 wherein said housing is securable by said lock pin and locking means to the outer surface of said band.

4. The bracelet of claim 1 wherein said EAS alarm-activating component is selected from the group consisting of:

a) a resonant circuit capable of interaction with a radio frequency signal, b) a magnetic element capable of interacting with an AC magnetic field, and c) components interactive with microwave and acousto-magnetic stimulus.

5. The protection bracelet of claim 1 wherein said upper shell portion is of circular, dome shaped configuration.

* * * * *